US005816857A

United States Patent [19]

Belopolsky

[11] Patent Number: 5,816,857

[45] Date of Patent: Oct. 6, 1998

[54] LOW COST FILTERED AND SHIELDED ELECTRONIC CONNECTOR

[75] Inventor: Yakov Belopolsky, Harrisburg, Pa.

[73] Assignee: Berg Technology, Inc., Reno, Nev.

[21] Appl. No.: 876,820

[22] Filed: Jun. 16, 1997

Related U.S. Application Data

[60] Continuation of Ser. No. 608,686, Feb. 29, 1996, Pat. No. 5,639,264, which is a division of Ser. No. 332,691, Oct. 31, 1994, Pat. No. 5,580,279.

[51] Int. Cl.[6] ..... H01R 13/66

[52] U.S. Cl. ..... 439/620; 439/638

[58] Field of Search ..... 439/620, 638, 439/651, 654; 333/181–185

[56] References Cited

U.S. PATENT DOCUMENTS

| | | | |
|---|---|---|---|
| 3,702,422 | 11/1972 | Schor | 317/101 CC |
| 4,580,866 | 4/1986 | Hagner | 439/620 |
| 4,657,323 | 4/1987 | Erbe | 339/17 R |
| 4,686,506 | 8/1987 | Farago | 340/347 DD |
| 4,722,022 | 1/1988 | Myers et al. | 361/424 |
| 4,726,790 | 2/1988 | Hadjis | 439/620 |
| 4,729,743 | 3/1988 | Farrar et al. | 439/620 |
| 4,781,624 | 11/1988 | Shepherd | 439/620 |
| 5,082,457 | 1/1992 | Wollscheidt | 439/620 |
| 5,201,855 | 4/1993 | Ikola | 439/608 |
| 5,224,878 | 7/1993 | Lurie et al. | 439/620 |
| 5,236,376 | 8/1993 | Cohen | 439/620 |
| 5,286,221 | 2/1994 | Fencl et al. | 439/607 |
| 5,286,224 | 2/1994 | Paulus | 439/620 |

FOREIGN PATENT DOCUMENTS 2602920 2/1988 France .

*Primary Examiner*—Gary F. Paumen
*Attorney, Agent, or Firm*—Daniel J. Long; M. Richard Page

[57] ABSTRACT

Disclosed is a connector comprising a front retaining member with a pin receiving passageway, a plurality of conductive pins extending through the passageway, a rear retaining means with a plurality a pin receiving means and a printed wiring board with capacitors and central apertures and being interposed between the front and rear retaining members so as to receive the pins in said apertures.

15 Claims, 10 Drawing Sheets

LOW COST FILTERED AND SHIELDED ELECTRONIC CONNECTOR

This application is a continuation of application Ser. No. 08/608,686, filed Feb. 29, 1996, now U.S. Pat. No. 5,639, 264 issued Jun. 17, 1997, which is a division of application Ser. No. 08/332,691, filed Oct. 31, 1994, now U.S. Pat. No. 5,580,279.

BACKGROUND OF INVENTION

1. Field of the Invention

The present invention relates to electrical connectors and, in particular, to filtered and shielded electronic connectors.

2. Brief Description of the Prior Art

Electromagnetic interference (EMI) is a common problem in modem telecommunications, computer and industrial control equipment. Because of this electromagnetic interference, connectors are required which provide electrical shielding as well as filtering of electrical signals of unwanted high frequency harmonics. Such filtering and shielding is conventionally carried out by means of connectors in which a front insulator and a planar capacitive filter are positioned between a front conductor shell and a rear conductive shell. A rear insulator is superimposed over the rear conductor shell and conductive pins retained by apertures in these elements pass longitudinally through the connector. Such connectors are relatively complex since the capacitive filter has to be connected by soldering to the rear metal shell to provide a continuous electrical ground. At the same time, complete shielding is achieved by soldering the rear shell to the front shell. The manufacturing and assembly of the conductive shells is generally the most expensive function in the manufacture of the overall connector. Large tooling expenses may also be incurred in order to manufacture the relatively complex insulators required in this connector. A need, therefore, exists for a relatively less expensive shielded and filtered connector which has relatively less complex and fewer parts.

SUMMARY OF THE INVENTION

The present invention is a low cost filtered and shielded electronic connector which comprises a front shell which has a number of passageways through which conductive pins pass. This front shell is connected end to end to a rear insulating member which has lateral walls and an end wall with a plurality of pin receiving apertures. Interposed between the front shell and the rear insulating member is a printed wiring board which also has apertures through which the conductive pins pass.

The printed wiring board is metalized on its front side adjacent the pin receiving apertures and around its edge. Capacitors are positioned between these metalized areas. On its rear side, the printed wiring board has a narrow metalized band immediately adjacent the apertures and a non-metalized band concentrically outwardly from that band. The remainder of the rear of the printed wiring board is preferably metalized. A ferrite filter may also be positioned between the printed wiring board and the rear insulator.

In another embodiment of the connector of the present invention, a conductive rear shell may be substituted for the rear insulator so that the printed wiring board with attached capacitors is interposed between a conductive front shell and a conductive rear shell, both of which have apertures to allow the conductive pins to pass through them.

In another embodiment there is a conductive front retaining means which has a pin receiving passage, a plurality of conductive pins and capacitive means in electrical contact with the conductive front retaining means. Integral conductive fastening means extend from the front retaining means to simultaneously allow for fixing the connector to a substrate and grounding the capacitive means.

Also encompassed within the present invention is a method for assembling an electrical connector by positioning a plurality of pins to pass through central apertures in a capacitive means interposed between a front retaining means and a rear retaining means and causing said pins to extend through a pin receiving passageway in the front retaining means and a pin receiving means in the rear retaining means.

BRIEF DESCRIPTION OF THE DRAWINGS

The connector of the present invention is further described with reference to the accompanying drawings in which.

DETAILED DESCRIPTION OF THE PREFERRED EMBODIMENTS

Figure 1:
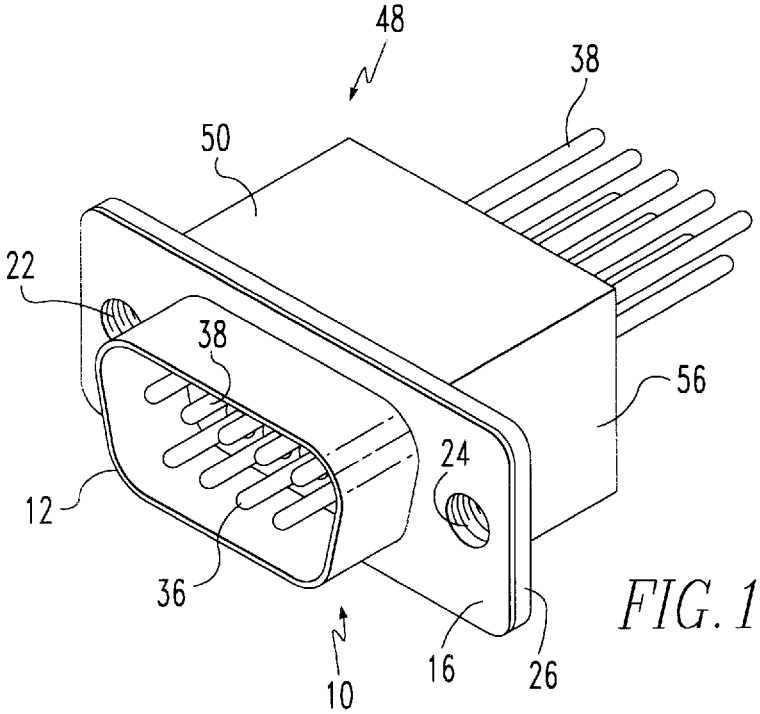
FIG. 1 is a perspective view of a preferred embodiment of this connector.
Figure 2:
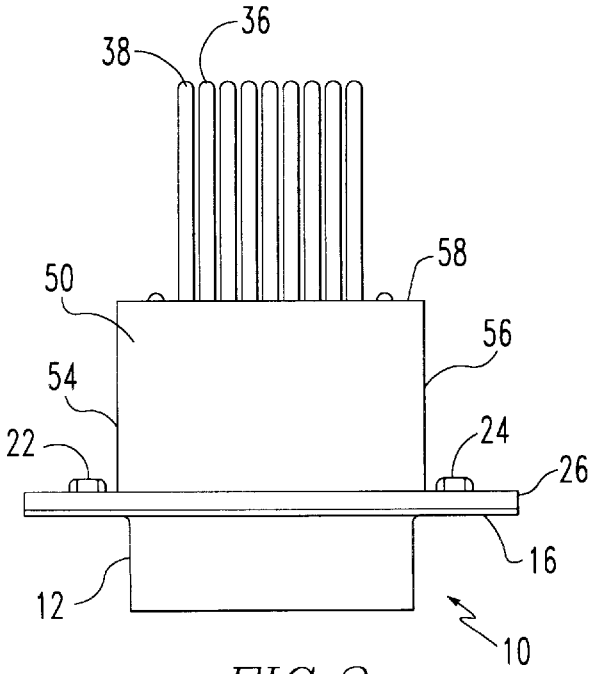
FIG. 2 is a side elevational view of the connector shown in FIG. 1.
Figure 3:
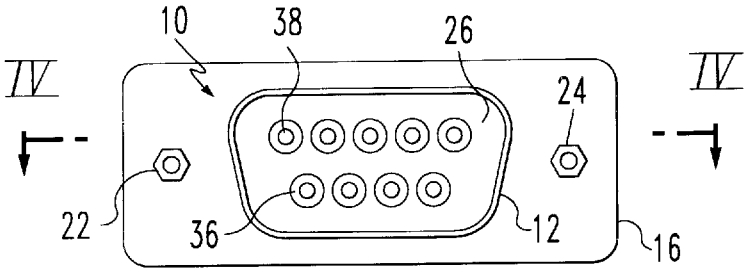
FIG. 3 is a front elevational view of the connector shown in FIG. 1.
Figure 4:
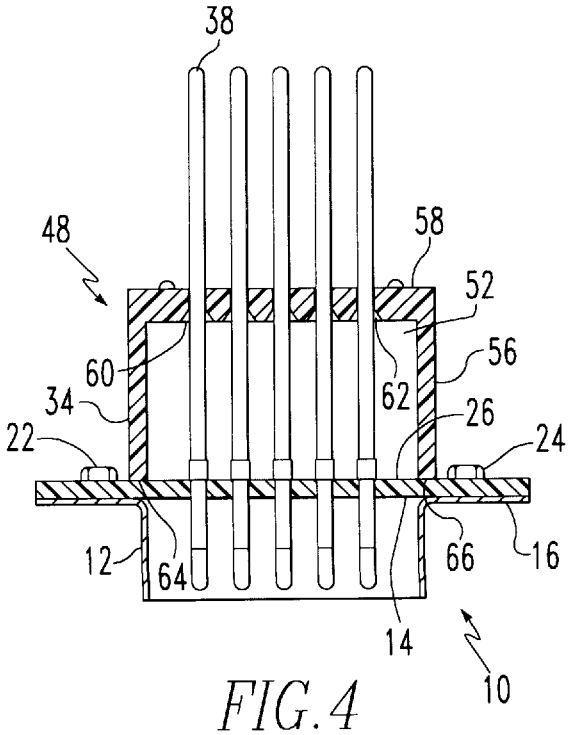
FIG. 4 is a cross sectional view taken through line IV—IV in FIG. 3.
Figure 5:
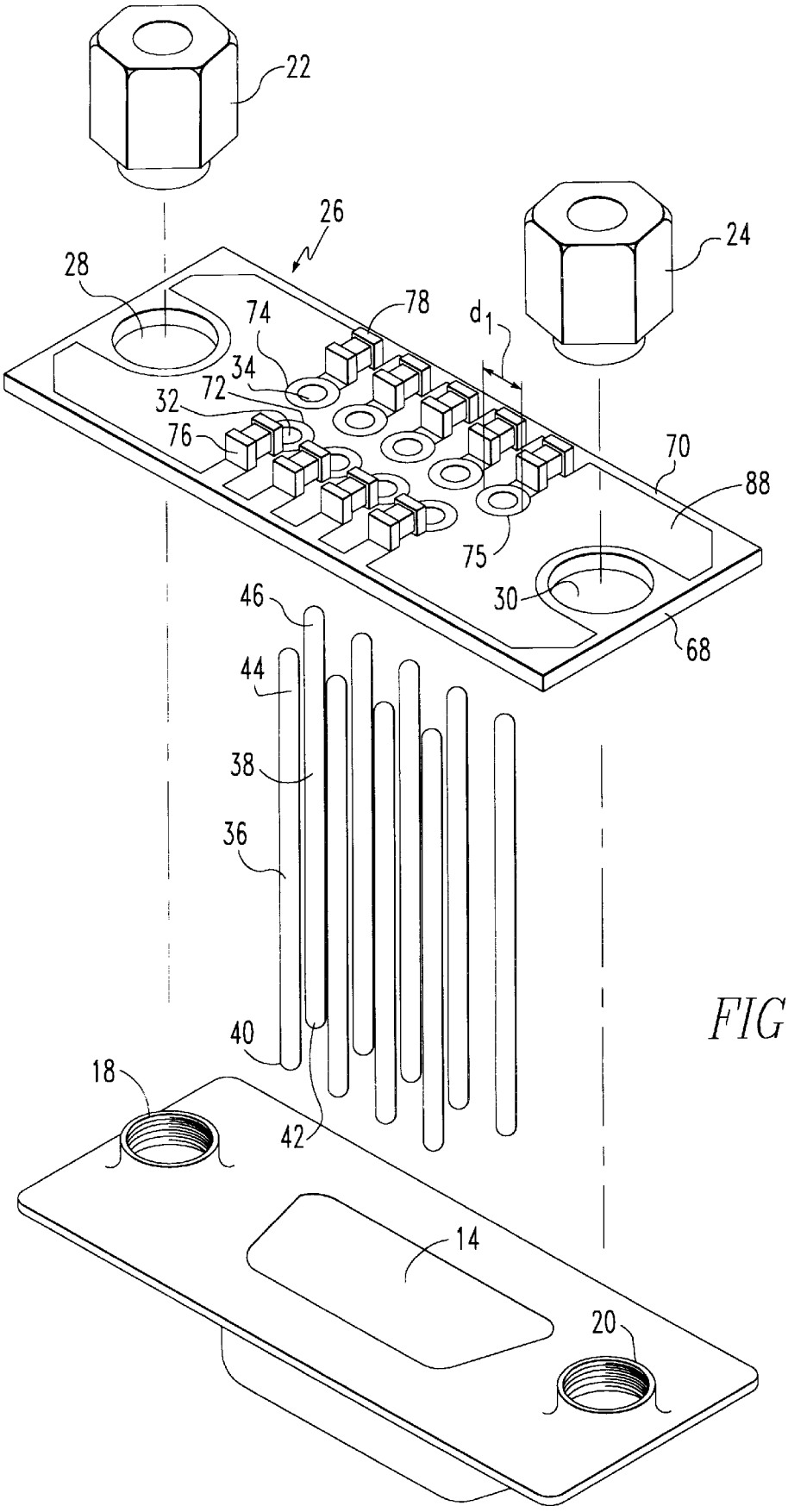
FIG. 5 is an exploded perspective of various elements of the connector shown in FIG. 1.
Figure 6:
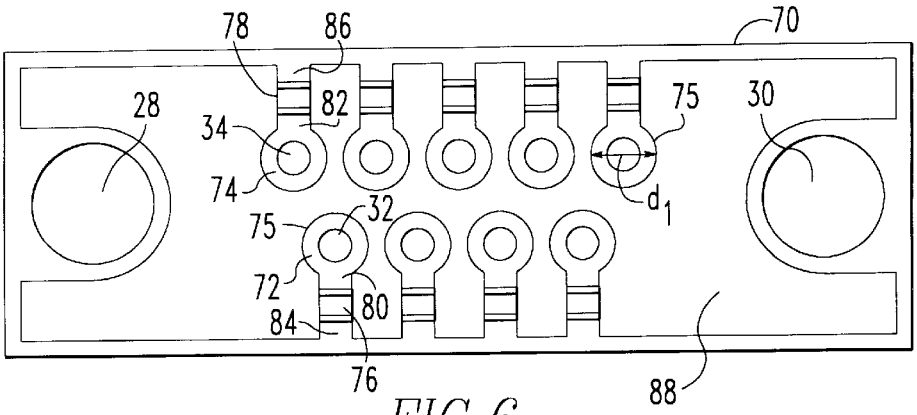
FIG. 6 is a component side view of the printed wiring board element shown in FIG. 5.
Figure 7:
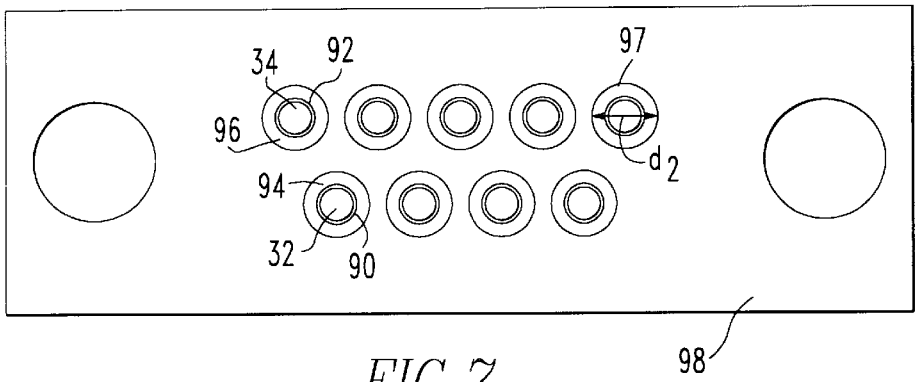
FIG. 7 is a reverse side view of the printed wiring board element shown in FIG. 6.
Figure 8:
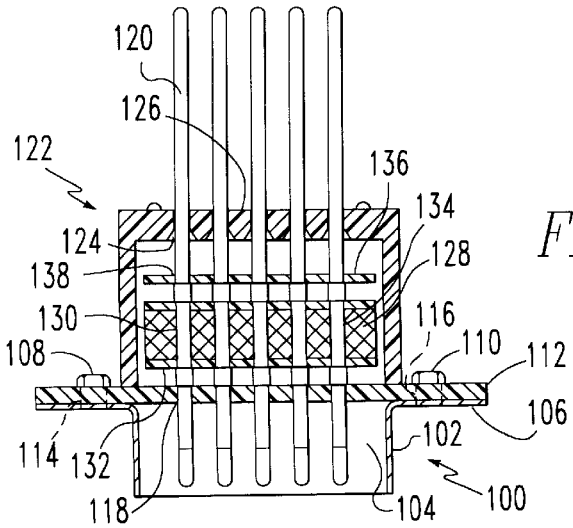
FIG. 8 is a vertical cross sectional view similar to FIG. 4 of an alternate embodiment of the connector shown in FIG. 4.

Referring to FIGS. 1 through 7, the connector comprises a conductive front shell shown generally at numeral 10 which has a lateral wall 12, a central aperture 14, and a flange 16 extending perpendicularly from the lateral wall. Extending rearwardly from the flange, there are screw thread openings 18 and 20, which are engaged respectively by rivet nuts 22 and 24 which fix printed wiring board 26 into a position adjacent the front shell by engagement through lateral apertures 28 and 30. The printed wiring board has a plurality of central apertures as at 32 and 34 for receiving conductive pins as at 36 and 38. These pins have respectively front ends 40 and 42 and rear ends 44 and 46. It will be observed that the front ends are engaged by the central apertures of the printed wiring board and are soldered to the board at that point. The connector also includes a rear insulated member shown generally at numeral 48, which is made up of side walls 50 and 52, end walls 54 and 56, and rear wall 58. For enhanced shielding this rear insulative member may also be metalized. There are a plurality of apertures as at 60 and 62 in the rear wall for receiving the rear ends of the conductive pins. The side and end walls rest on the printed wiring board at the terminal edges as at 64 and 66. The rear insulated member is held in engage by means of frictional forces with the conductive pins where they pass through the apertures in the rear wall. Referring particularity to FIGS. 5 through 7, it will be seen that the printed wiring board has a metalized edge 68. Adjacent this edge there is on the component side a metalized strip 70. On the component side of the wiring board adjacent each of the central apertures, there are metalized bands as at 72 and 74, which are concentrically positioned outwardly from each of these apertures and which have an outer edge which as at 75 is circular in shape. This outer edge defines an overall diameter $d_1$ of the apertures and the adjacent metalized strip. On the component side of the printed wiring board there are also a number of capacitors as at 76 and 78 which are positioned between the metalized strip surrounding the central apertures and the edge of the wiring board. Metalized extensions as at 80 and 82 extend from the strip surrounding the aperture on one side toward the capacitors and as at 84 and 86 which extend from the capacitors toward the strip surrounding the edge of the wiring board. The remainder of the component side of the printed wiring board is comprised of a non-metalized area 88. Referring particularly to FIG. 7, it will be seen that on the reverse side of the printed wiring board there is a thin metalized band immediately adjacent the central apertures as at 90 and 92. Outwardly from these thin bands, there are concentric non-metalized areas as at 94 and 96 and the outward edges of these areas as at 97 define a diameter ($d_2$), on the reverse side of the boards. On the remainder of the rear side of the printed wiring board there is a metalized main area 98. Referring to FIG. 8 in an alternate arrangement the connector includes a front shell generally at 100, which includes a lateral wall 102, a central aperture 104 and a perpendicular flange 106. Rivet nuts 108 and 110 engage printed wiring board 112 to the flange of the front shell by engaging lateral apertures 114 and 116 in that printed wiring board. There are apertures as at 118 in the printed wiring board to allow conductive pins as at 120 to pass therethrough. There is also a rear insulative member shown generally at 122, which has apertures as at 124 on its rear wall 126 to also receive the conductive member. Inside this rear insulative member there is a ferrite filter 128, having apertures as at 130 along with plastic wafers 132 and 134 which serve to cushion the ferrite element and the wiring board and which are perforated in positions adjacent to the apertures in the ferrite filter so as to allow the conductive pins to pass there through. Superimposed over this ferrite filter, there is another printed wiring board 136 with apertures as at 138 through which the conductive pins pass. The printed wiring board 112 and 136 are essentially identical to the one shown in FIGS. 5 through 7. The printed wiring board 138 is essentially similar to the printed wiring board described hereafter in connection with FIGS. 10 and 11.

Figure 9:
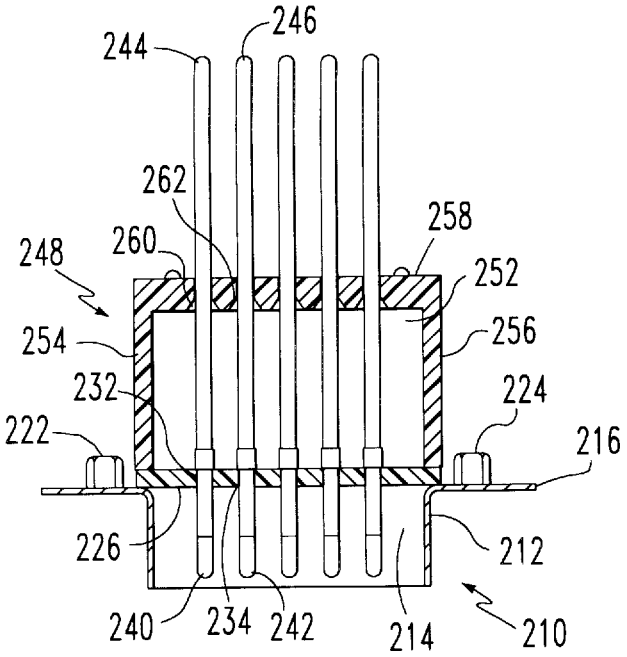
FIG. 9 is a cross sectional view of another preferred embodiment of the connector of the present invention.
Figure 12:
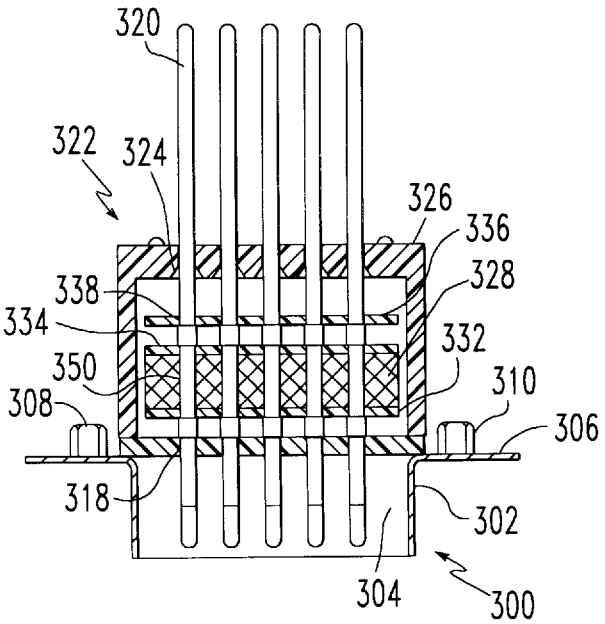
FIG. 12 is a vertical cross section of an alternate embodiment of the connector shown in FIG. 9.
Figure 10:
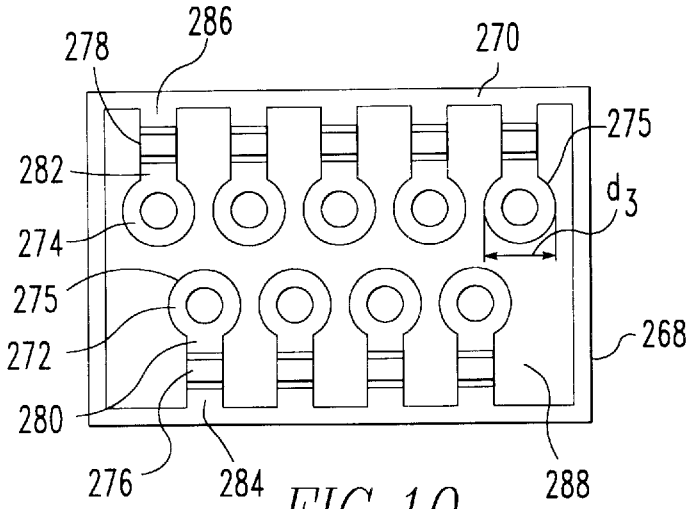
FIG. 10 is a component side view of the printed wiring board element shown in FIG. 9.
Figure 11:
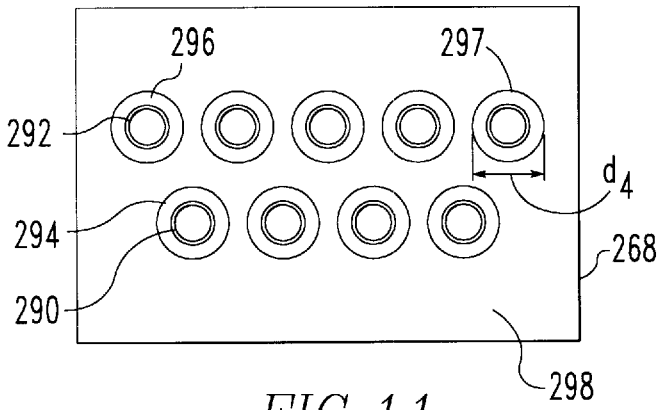
FIG. 11 is a reverse side view of the printed wiring board element shown in FIG. 9.
Figure 14:
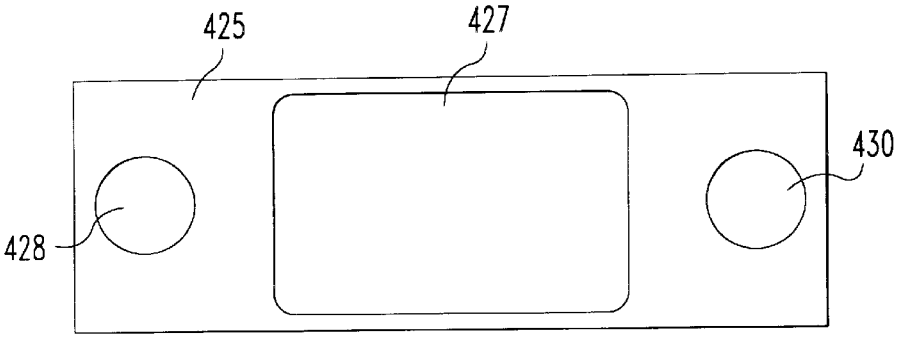
FIG. 14 is a component side view of the printed wiring board retainer member shown in FIG. 13.
Figure 15:
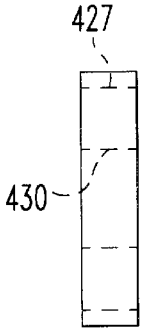
FIG. 15 in an end view of the printed wiring board retaining member shown in FIG. 14.

Referring to FIGS. 9 through 11, another embodiment of the connector of this invention comprises a conductive front shell shown generally at numeral 210 which has a lateral wall 212, a central aperture 214, and a flange 216 extending perpendicularly from the lateral wall. Extending rearwardly from the flange, there are rivet nuts 222 and 224 which are used to attach the connector to a mounting panel (not shown). The printed wiring board 226 is fixed into a position adjacent the front shell by soldering it to the front shell. The printed wiring board has a plurality of central apertures as at 232 and 234 for receiving conductive pins as at 236 and 238. These pins have respectively front ends 240 and 242, and rear ends 244 and 246. It will be observed that the front ends are engaged by the central apertures of the printed wiring board. The connector also includes a rear insulated member shown generally at numeral 248, which is made up of side walls as at 252. End walls 254 and 256, and rear wall 258. There are a plurality of apertures as at 260 and 262 in the rear wall for receiving the rear ends of the conductive pins. Referring particularity to FIGS. 10 and 11, it will be seen that the printed wiring board has a metalized edge 268. Adjacent this edge there is on the component side a metalized strip 270. On the component side of the wiring board adjacent each of the central apertures, there are metalized band as at 272 and 274, which are concentrically positioned outwardly from each of these apertures and which have an outer edge which as at 275 is circular in shape. This outer edge defines an overall diameter $d_4$ of the apertures and the adjacent metalized strip. On the component side of the printed wiring board there are also a number of capacitors as at 276 and 278 which are positioned between the metalized strip surrounding the central apertures and the edge of the wiring board. Metalized extensions as at 280 and 282 extend from the band surrounding the aperture on one side toward the capacitors and as at 284 and 286 which extend from the capacitors toward the strip surrounding the edge of the wiring board. The remainder of the component side of the printed wiring board is comprised of a non-metalized area 288. Referring particularly to FIG. 11, it will be seen that on the reverse side of the printed wiring board there is a thin metalized band immediately adjacent the central apertures as at 290 and 292. Outwardly from these thin bands, there are concentric non-metalized areas as at 294 and 296 and the outward edges of these areas as at 297 define a diameter ($d_3$), on the reverse side of the boards. On the remainder of the rear side of the printed wiring board there is a metalized main area 298. Referring to FIG. 12, in an alternate arrangement the connector includes a front shell generally at 300, which includes a lateral wall 302, a central aperture 304 and a perpendicular flange 306. Rivet nuts 308 and 310 engage the flange of the front shell. There are apertures as at 318 in the printed wiring board to allow conductive pins as at 320 to pass therethrough. There is also a rear insulative member shown generally at 322, which has apertures as at 324 on its rear wall 326 to also receive the conductive member. Inside this rear insulative member there is a ferrite filter 328, having apertures as at 330 along with plastic wafers 332 and 334 which are perforated in positions adjacent to the apertures in the ferrite filter so as to allow the conductive pins to pass there through.

By "ferrite" what is meant is any of the group of ceramic ferromagnetic compounds of ferric oxide with other oxides including, without limitation, such compounds with spinel crystalline structure characterized by both high magnetic permeability and electrical resistivity and materials having similar magnetic and electrical characteristics which are used for noise reduction or elimination purposes. Superimposed over this ferrite filter, there is another printed wiring board 336 with apertures as at 338 through which the conductive pins pass. The printed wiring board 312 and 336 are essentially identical to the one shown in FIGS. 10 and 11.

Figure 16:
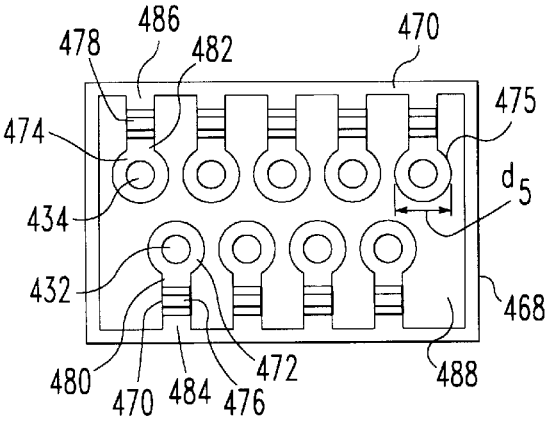
FIG. 16 is a component side view of the printed wiring board element shown in FIG. 13.
Figure 17:
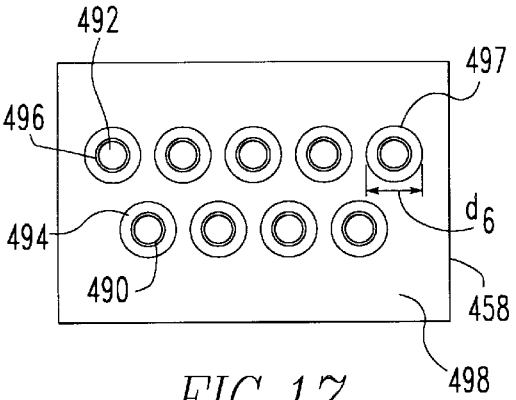
FIG. 17 is a reverse view of the printed wiring board element shown in FIG. 16.
Figure 13:
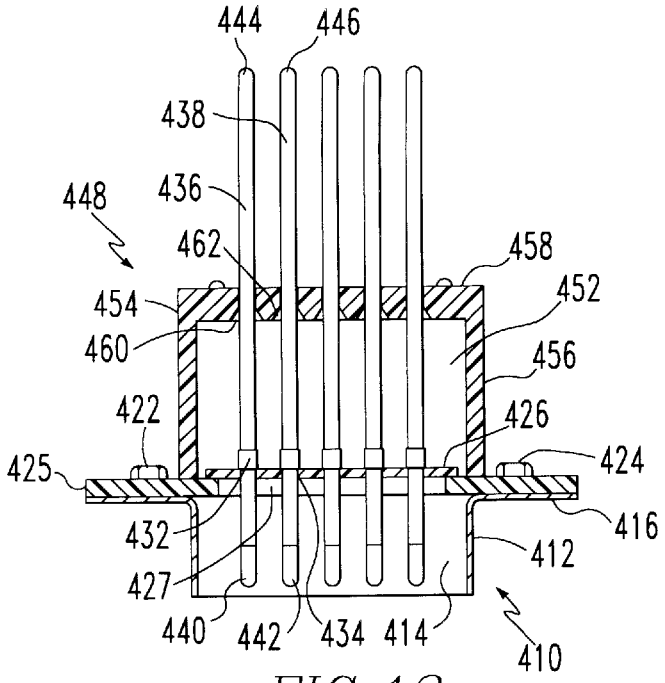
FIG. 13 is a vertical cross section similar to FIG. 4 of another preferred embodiment of the connector of the present invention.

Referring to FIGS. 13 through 17, the connector comprises a conductive front shell shown generally at numeral 410 which has a lateral wall 412, a central aperture 414, and a flange 416 extending perpendicularly from the lateral wall. Extending rearwardly from the flange, there are screw thread openings which are engaged by rivet nuts 422 and 424. By means of a retainer member 425 is held in the fixed printed wiring board 426 a position adjacent the front shell by being held in a central aperture 427 of the retainer by engagement through lateral apertures 428 and 430. The printed wiring board has a plurality of central apertures as at 432 and 434 for receiving conductive pins as at 436 and 438. These pins have respectively front ends 440 and 442 and rear ends 444 and 446. It will be observed that the front ends are engaged by the central apertures of the printed wiring board. The connector also includes a rear insulated member shown generally at numeral 448, which is made up of side walls as at 452. End walls 454 and 456, and rear wall 458. There are a plurality of apertures as at 460 and 462 in the rear wall for receiving the rear ends of the conductive pins. Referring particularity to FIGS. 16 and 17, it will be seen that the printed wiring board has a metalized edge 468. Adjacent this edge there is on the front side a metalized strip 470. On the front side of the wiring board adjacent each of the central apertures, there is a metalized band as at 472 and 474, which are concentrically positioned outwardly from each of these apertures and which has an outer edge 475 which is circular in shape. This outer edge defines an overall diameter $d_5$ of the apertures and the adjacent metalized strip. On the component side of the printed wiring board there are also a number of capacitors as at 476 and 478 which are positioned between the metalized strip surrounding the central apertures and the edge of the wiring board. Metalized extensions as at 480 and 482 extend from the strip surrounding the aperture on one side toward the capacitors and as at 484 and 486 which extend from the capacitors toward the strip surrounding the edge of the wiring board. The remainder of the component side of the printed wiring board is comprised of a non-metalized area 488. Referring particularly to FIG. 17, it will be seen that on the reverse side of the printed wiring board there are thin metalized band as at 490 and 492 immediately adjacent the central apertures. Outwardly from these thin bands, there are concentric non-metalized areas as at 494 and 496 and the outward edges as at 497 of these areas define a diameter ($d_6$), on the component side of the boards. On the remainder of the rear side of the printed wiring board there is a metalized main area 498.

Figure 18:
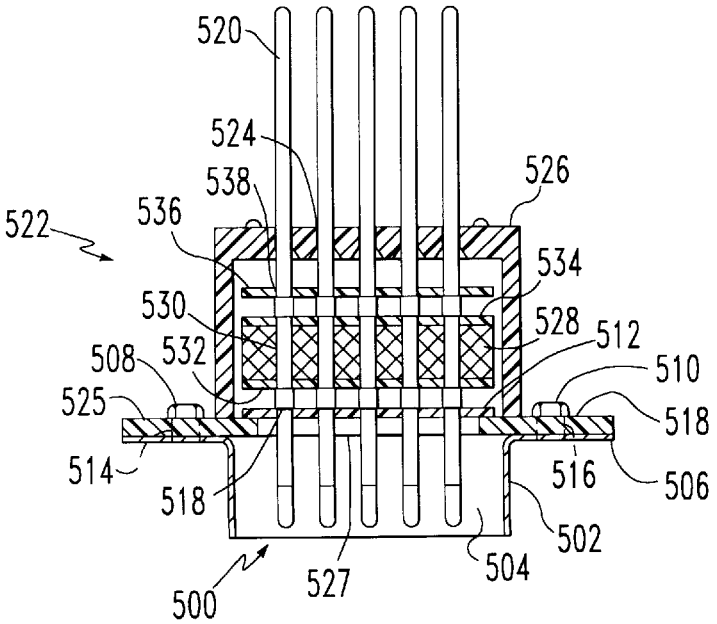
FIG. 18 is a vertical cross sectional view similar to FIG. 4 of another preferred embodiment of the connector of the present invention.

Referring to FIG. 18, in an alternate arrangement the connector includes a front shell generally at 500, which includes a lateral wall 502, a central aperture 504 and a perpendicular flange 506. Rivet nuts 508 and 510 engage printed wiring board 512 to the flange of the front shell. By engaging lateral apertures 514 and 516 in that printed wiring board. There are apertures as at 518 in the printed wiring board to allow conductive pins as at 520 to pass therethrough. There is also a rear insulative member shown generally at 522, which has apertures as at 524 on its rear wall 526 to also receive the conductive member. There is also a board retainer member 525 with a central aperture 527 to which wiring board 512 is welded. This retainer member is essentially similar to retainer 425. Inside this rear insulative member there is a ferrite filter 528, having apertures as at 530 along with plastic wafers 532 and 534 which are perforated in positions adjacent to the apertures in the ferrite filter so as to allow the conductive pins to pass there through. Superimposed over this ferrite filter, there is another printed wiring board 536 with apertures as at 538 through which the conductive pins pass. The printed wiring board 512 and 536 are essentially identical to the one shown in FIGS. 16 and 17.

Figure 19:
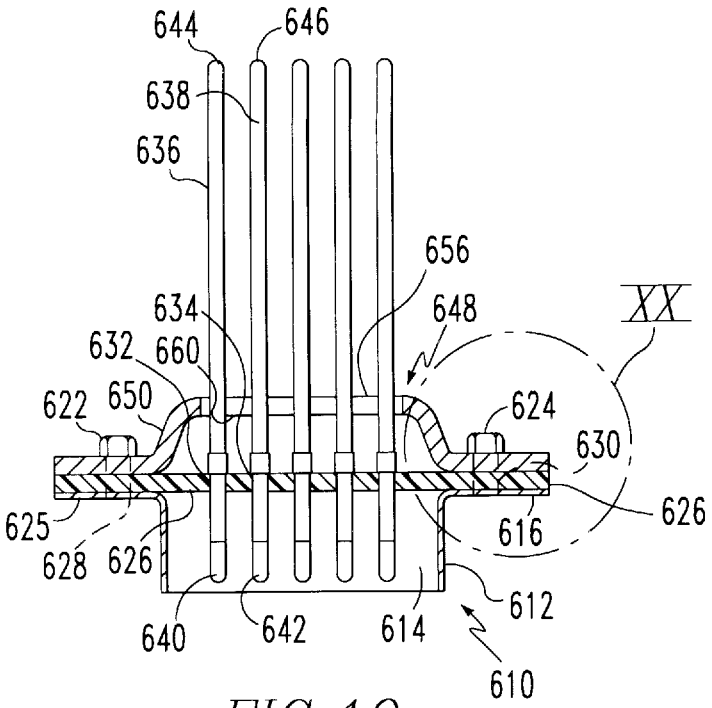
FIG. 19 is a vertical cross sectional view similar to FIG. 4 of another preferred embodiment of the connector of the present invention.
Figure 20:
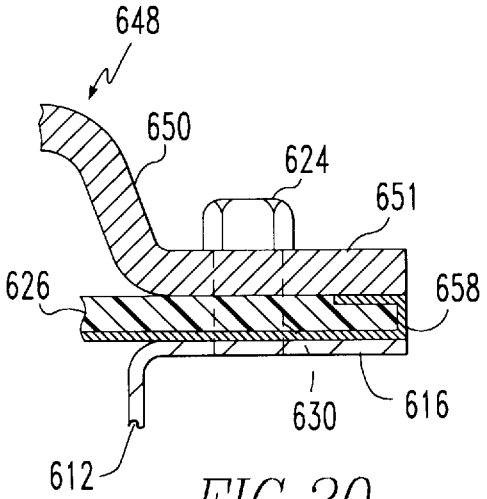
FIG. 20 is a detailed view of the area within circle XX in FIG. 19.

Referring to FIGS. 19 and 20, an embodiment of the connector of this invention comprises a conductive front shell shown generally at numeral 610 which has a lateral wall 612, a central aperture 614, and a flange 616 extending perpendicularly from the lateral wall. Extending rearwardly from the flange, there are screw thread openings which are engaged by rivet nuts 622 and 624. The printed wiring board 626 is fixed into a position adjacent the front shell by engagement through lateral apertures 628 and 630. The printed wiring board has a plurality of central apertures as at 632 and 634 for receiving conductive pins as at 636 and 638. These pins have respectively front ends 640 and 642 and rear ends 644 and 646. It will be observed that the front ends are engaged by the central apertures of the printed wiring board. The connector also includes a rear conductive member shown generally at numeral 648, which is made up of a lateral wall 650 and a peripheral flange 651 and a rear wall 656. There is a single elongated aperture 660 in the rear wall for receiving the rear ends of the conductive pins. Referring particularity to FIG. 20, it will be seen that the printed wiring board has a metalized edge 658, and it is essentially identical to the printed wiring board shown in FIGS. 5 through 7.

Figure 21:
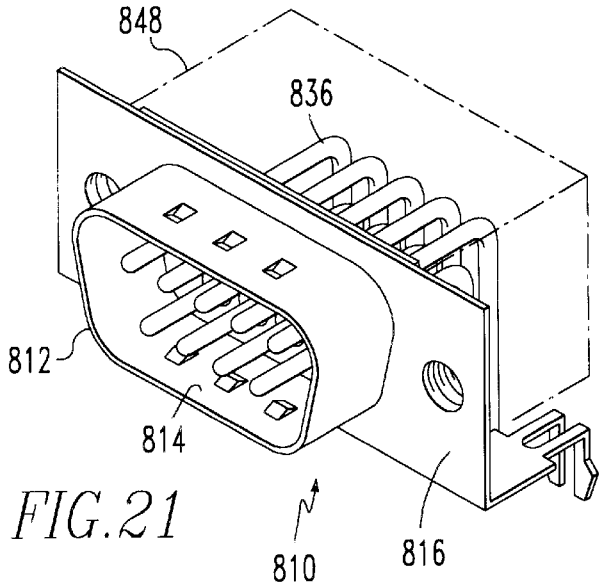
FIG. 21 is a front perspective view of another preferred embodiment of the connector of the present invention.
Figure 22:
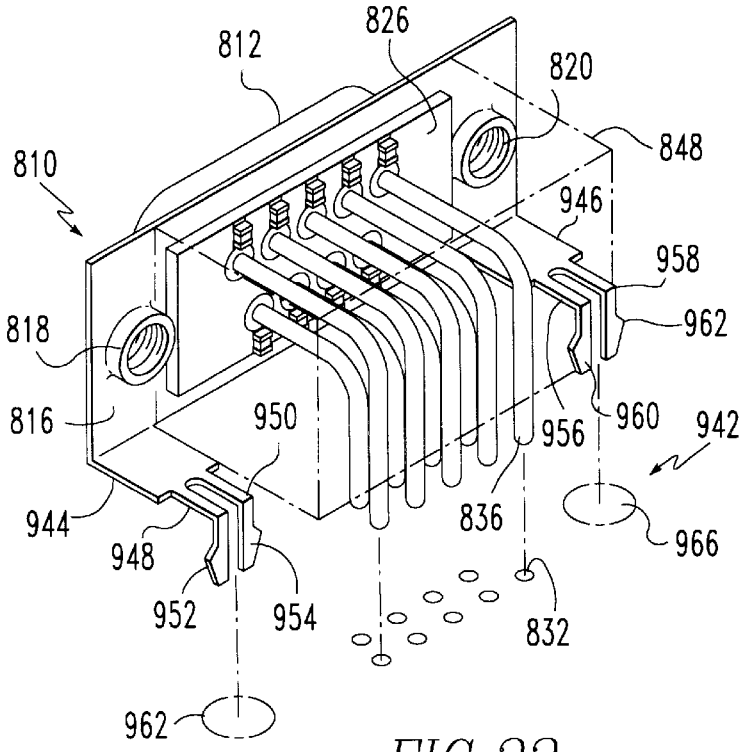
FIG. 22 is a rear perspective view of the connector shown in FIG. 20.

Referring to FIGS. 21 and 22, still another embodiment is illustrated in which there is a conductive front shell shown generally at numeral 810 which includes a lateral wall 812, a central aperture 814 and a perpendicular flange 816 which has screw threads 818 and 820 which may be engaged as described above with a rivet nut (not shown) a printed wiring board 826 is positioned on the reverse side of the conductive shell. As described above, conductive pins as at 836 pass through apertures as at 832 in the printed wiring board. As described above, these pins are housed within a rear retaining member shown in broken lines at 848 where the turn at a right angle and extend downwardly to engage pin receiving apertures as at 940 in a wiring board shown generally at 942. Extending perpendicularly from the flange there are two conductive rearward extensions 944 and 946. The rearward extension 944 has two resilient terminal prongs 948 and 950 which extend rearwardly then downwardly and at their terminal ends have outward projections 952 and 954. Similarly, rearward extension 946 has two resilient terminal prongs 956 and 958 which have outward projections 960 and 962. In both of the sets of prongs, the two prongs are compressible toward each other to be engageable with retaining apertures respectively at 964 and 966 in the wiring board when inward compression on the prongs is relaxed. Those skilled in the art will appreciate that this embodiment will allow the connector to be easily grounded and fixed to a printed wiring board without the need for additional parts.

It will be appreciated that a filtered and shielded electronic connector has been described which can be easily and inexpensively manufactured without need of soldering a capacitive filter to a rear shell or of soldering the front shell to the rear shell or without the need of manufacturing complex insulators.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

(a) a front retaining means comprising a conductive shell having a pin receiving passageway;

(b) a plurality of conductive pins extending through the passageway of the front retaining means;

(c) a concave insulative rear retaining means having apertures through which the conductive pins pass; and (d) a capacitive means comprising a printed wiring board having a plurality of central apertures and being interposed between said front retaining means and rear retaining means so as to receive the pins in said apertures, and said board having a component side oriented toward the rear retaining means and a reverse side oriented toward the front retaining means and a peripheral edge, and on the component side of said board there is a conductive strip adjacent the peripheral edge on said component side, and outwardly adjacent at least some of the central apertures there are conductive bands and a capacitor is positioned between at least some of said conductive bands and the conductive strip adjacent the peripheral edge, and on the reverse side of said board a non-conductive area surrounds at least some of the central apertures and said non-conductive areas are surrounded by conductive areas.

2. The connector of claim 1 wherein an additional filtering means is positioned between the capacitive means and the rear retaining means.

3. The connector of claim 1 wherein outwardly adjacent each of the central apertures there is a concentric metalized band having an outer circular edge.

4. The connector of claim 3 wherein a capacitor is positioned between each of the metalized bands and the metalized strip adjacent the edge.

5. The connector of claim 4 wherein a metalized extension connects each of the capacitors with the metalized strip.

6. The connector of claim 5 wherein a metalized extension connects each of said capacitors with one of said metalized bands surrounding one of said central apertures.

7. The connector of claim 6 wherein on the reverse side of the printed wiring board adjacent each of the central apertures there is a narrow metalized band.

8. The connector of claim 7 wherein on the reverse side of the printed wiring board a non-metalized area extends concentrically from each of each of said metalized bands and said non-metalized area has an outer circular edge.

9. The connector of claim 8 wherein on the component side of the printed wiring board each of the outer circular edges of the metalized boards has a diameter which is generally uniform with the diameters of each of the other diameters of said outer circular edges of the metalized bands and on the reverse side of the printed wiring board each of the outer circular edges of the non-metalized areas has a diameter which is generally uniform with the diameters of each of the other diameters of each of the other outer diameters of said outer circular edges of non-metalized areas and the diameters of the outer circular edges of the non-metalized areas are less than the diameters of the outer edges of the metalized bands.

10. The connector of claim 9 wherein outside of the edges of the non-metalized bands the rear side of the printed wiring board is completely metalized.

11. The connector of claim 10 wherein the pins are soldered to the metalized bands on the component side of the printed wiring board.

12. The connector of claim 11 wherein the pins are soldered to the metalized bands on the reverse side of the printed wiring board.

13. The connector of claim 1 wherein the front conductive shell has a peripheral flange.

14. The electrical connector of claim 13 wherein the printed wiring board is retained beneath the concave rear retaining means without being engaged by the peripheral flange.

15. The electrical connector of claim 1 wherein the printed wiring board is soldered to the conductive shield.

* * * * *